United States Patent [19]

Schrewe et al.

[11] 4,143,866

[45] Mar. 13, 1979

[54] DEOXIDIZING AND/OR DESULFURIZING OF STEEL

[75] Inventors: Hans Schrewe, Duisburg; Fritz-Peter Pleschiutschnigg, Düsseldorf, both of Fed. Rep. of Germany

[73] Assignee: Mannesmann Aktiengesellschaft, Düsseldorf, Fed. Rep. of Germany

[21] Appl. No.: 763,562

[22] Filed: Jan. 28, 1977

[30] Foreign Application Priority Data

Feb. 2, 1976 [DE] Fed. Rep. of Germany ..... 2604296

[51] Int. Cl.[2] ..... C21C 7/00

[52] U.S. Cl. ..... 266/216; 75/58

[58] Field of Search ..... 75/61, 93 G; 239/251; 261/87, 93; 266/216, 217, 225, 226

[56] References Cited

U.S. PATENT DOCUMENTS

| | | | |
|---|---|---|---|
| 40,472 | 11/1863 | Gerhardt | 266/216 |
| 903,788 | 11/1908 | Schmidt | 239/251 |
| 2,915,386 | 12/1959 | Strauss | 266/216 |
| 3,972,709 | 8/1976 | Chia et al. | 75/61 |

*Primary Examiner*—Gerald A. Dost

*Attorney, Agent, or Firm*—Smyth, Pavitt, Siegemund, Jones & Martella

[57] ABSTRACT

The solid treatment material is contained in rotationally symmetrical, flotation body having a ballast weight and openings for discharging jets of vaporized treatment material into the steel while the body floats, and the jets have a tangential component so that the body rotates and wobbles and the jets vary their direction to distribute the treatment material.

6 Claims, 4 Drawing Figures

(A-B)

(A-B)

DEOXIDIZING AND/OR DESULFURIZING OF STEEL

BACKGROUND OF THE INVENTION

The present invention relates to treating such as deoxidizing and/or desulfurizing molten steel.

It is well known in the art of steel making that the melt may have to be deoxidized or desulfurized or both. For this, it is known to blow solid material in a carrier gas into the molten steel, using blowing pipes that dip into the melt. The solid material is used in powdery consistency and one has used here, for example, Ca Mg. The powder melts and dissolves in the molten steel.

The aforementioned method has the drawback that it can be practiced only in a localized fashion and the ladle has to be shifted in relation to the treatment equipment which is very time-consuming. Moreover, the immersion pipe used for blowing the gas powder mixture into the steel is inherently subjected to buoyancy which interfers with proper operation.

DESCRIPTION OF THE INVENTION

It is an object of the present invention to provide a new and improved method and equipment for treating molten steel, e.g., for purposes of deoxidizing and/or desulfurizing the steel.

It is a specific object of the present invention to treat steel in a non-localized fashion overcoming specifically the drawbacks outlined above.

In accordance with the preferred embodiment of the present invention, it is suggested to place the solid treatment material into a fireproof container having also ballast weight to become a floatation body. The body has radial/tangential openings, so that vaporized treatment material when emerging produces jets that cause the body to rotate and wobble, so that the treatment material is discharged through rotating jets. This way, the e.g., desulfurizing and/or deoxidizing material is well distributed in the molten steel on account of the rotation generally and due to the fact that preferably plural jets blow the treatment material further into the steel and in different, varying directions. The floatation body is preferably constructed to have rotational symmetry in relation to the axis about which the jets cause it to rotate.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a vessel or body 1 having a spherical chamber 11 and a stem 12. The vessel as a whole is of rotational symmetric configuration with respect to an axis 13, and is made of fireproof refractory material such as a ceramic, which does not melt in molten steel.

Figure 1:
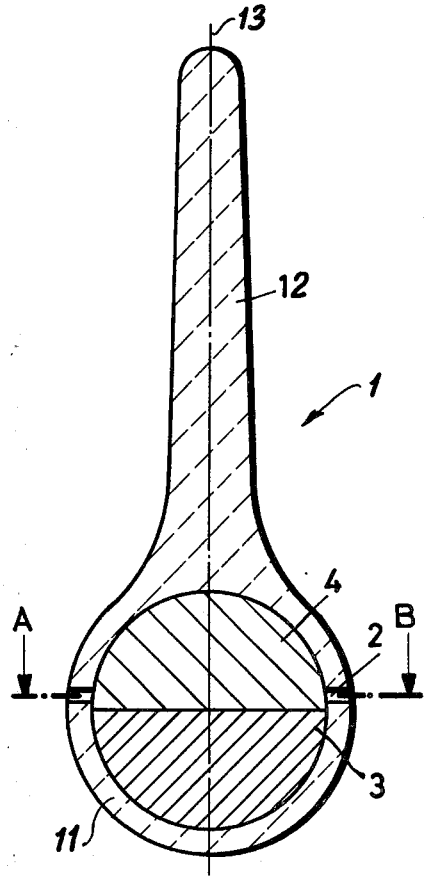
FIG. 1 is a section view through a vertical plane of a floatation and dispensing body in accordance with the preferred embodiment of the present invention.

The chamber 11 is closed or has been closed when made of plural parts, except that openings 2 are provided. These openings are of curved configuration with a smaller angle to the normal at the respective entrance side in the interior of the chamber than at the outer, exit side, i.e. the ducts and openings 2 each veer significantly towards the local tangent line at the point of exit.

The chamber 11 contains a ballast weight 3 filling about the lower half of the chamber. The load 3 is also made of material that will not melt, and its specific weight or density is higher than that of steel. Weight 3 fills the chamber only to the extent that its top surface is and remains below the level of the ducts or openings 2 so that these are not blocked.

The top portion of chamber 11 of floatation body 1 is filled with a solid material to be used for deoxidation and/or desulfurization of steel. The material is basically of the known type, and it will vaporize when heated particularly upon immersing chamber 11 in molten steel.

Figure 2:
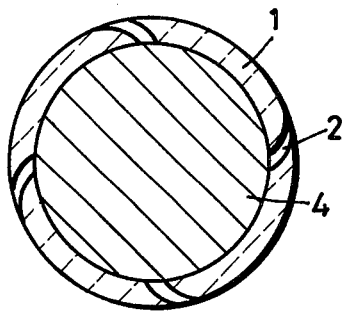
FIG. 2 is a section view along lines A–B in FIG. 1.
Figure 3:
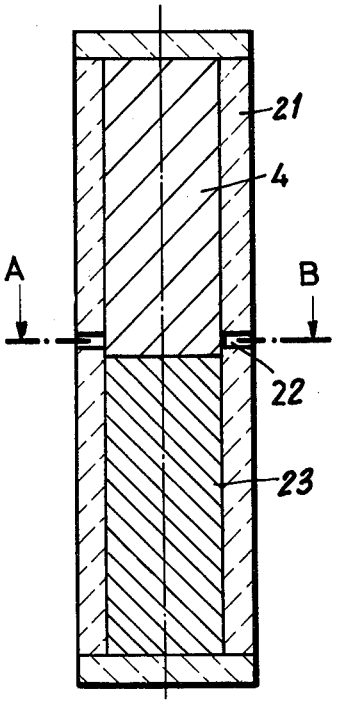
FIG. 3 is a section view similar to FIG. 1 but of a modified version of the preferred embodiment.
Figure 4:
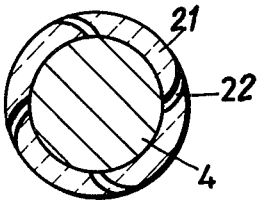
FIG. 4 is a section view along lines A–B in FIG. 3.

The floatation body 21 as per FIGS. 3 and 4 differs from the one shown in FIGS. 1 and 2 in that it has an overall cylindrical configuration. The cylindrical body 21 has a cylindrical inner chamber about half of which is filled with a ballast material 23 while top part of body 21 is again filled with the desulfurizing and/or deoxidizing material 4. Openings 22 in the side wall have the same configuration as openings 2 of FIGS. 1 and 2.

In operation, the body 1 or 21 is dropped into the molten steel and may drop to the bottom, but a portion may still project above the surface. Thus, as a whole, the body may have a specific weight less than molten steel. In view of the fact that ballast 3 or 23 is heavier than the material 4, the center of gravity is well below the geometric center and either body, 1 or 21, will float in the upright position as illustrated.

Soon the material 4 will begin to melt and to evaporate. The heated gas will be pressurized sufficiently to overcome the ferrostatic pressure and will, in fact, emerge as jets from nozzle openings 2 or 22. As a consequence, the body 1, 21, will begin to rotate thereby agitating the steel around it so that the body undergoes a nutating or wobble motion. This feature is highly advantageous as it aids significantly in the distribution of the gaseous substance. It should be noted that the solid filling 4 does not come into contact with the steel (except in the very first instance of submergence) as the gas of the jet separates the solid material 4 from the steel.

The release of some material 4 from the body changes, the buoyancy conditions and the body will gradually float up which is an additional aspect that aids in the distribution of the desulfurization and/or deoxidation. Exhaustion of the supply can be detected when the body floats up and projects above the surface of the molten steel by a specific amount, and the body can now be removed.

By way of example, a body 1 or 21 may have a length of about 2000 mm and an outer diameter of 500 mm. The body is made of fireproof material and has a wall thickness of about 100 mm. The chamber is filled by about 50% with the deoxidation or other agent while the remaining 50% is occupied by ballast weight. If the specific weight of that ballase is about 15 grams/cm$^3$, then the body will be immersed in a steel bath by about 75% of its length or 1,500 mm. The openings 2, 22, are, of course, under the steel surface. As gas develops, the body begins to rotate and wobble or tumble, and it will also begin to rise. If the body is made of several parts, the connection elements serve additionally as ballast weight because they are heavier than the ceramic.

The invention is not limited to the embodiments described above but all changes and modifications thereof not constituting departures from the spirit and scope of the invention are intended to be included.

We claim:

1. A device for treating molten steel comprising:

a hollow, floatation body for free floating without external attachment and made of refractory material and containing ballast weight means in the lower portion of the hollow body sufficient to maintain the body submerged in molten steel and sufficiently low to maintain the body in an upright disposition, said hollow body further containing solid treatment material for treating the steel, the treatment material being disposed above the ballast weight means, the body as filled with said materials will initially be at least almost completely submerged, the body being constructed to have openings disposed near a boundary between the material and the ballast weight means, there being no openings near a top portion of the hollow interior, the openings being oriented to an axis of the body with a tangential component so that the openings will undergo rotation when the body is submerged in steel and pursuant to evaporation of said treatment material as the evaporated treatment material is injected by the openings into the molten steel, the ballast material does discharge.

2. A device as in claim 1, said treatment material being a material for deoxidizing the steel.

3. A device as in claim 1, said treatment material being a material for desulfurizing steel.

4. A device as in claim 1, said treatment material being a material for desulfurizing and deoxidizing the steel.

5. A device as in claim 1, said body having rotationanlly symmetric contour in relation to said axis, said openings being effective in a plane transversely to said axis.

6. A device as in claim 1, said openings having curved contour veering more towards a tangential direction in radial outward direction.

* * * * *